US009309069B2

(12) United States Patent
Ito et al.

(10) Patent No.: US 9,309,069 B2
(45) Date of Patent: Apr. 12, 2016

(54) SHEET SEPARATING APPARATUS

(71) Applicant: BROTHER KOGYO KABUSHIKI KAISHA, Nagoya-shi, Aichi-ken (JP)

(72) Inventors: Tetsuo Ito, Nagoya (JP); Hideaki Utagawa, Hadano (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/668,371

(22) Filed: Mar. 25, 2015

(65) Prior Publication Data

US 2015/0274455 A1 Oct. 1, 2015

(30) Foreign Application Priority Data

Mar. 31, 2014 (JP) ..... 2014-072002

(51) Int. Cl.
*B65H 3/52* (2006.01)

(52) U.S. Cl.
CPC ..... *B65H 3/5223* (2013.01); *B65H 3/52* (2013.01); *B65H 2405/1118* (2013.01)

(58) Field of Classification Search
CPC ..... B65H 3/52; B65H 3/5223; B65H 3/5238; B65H 2405/1118
USPC ..... 271/167
See application file for complete search history.

(56) References Cited

U.S. PATENT DOCUMENTS

| | | | | |
|---|---|---|---|---|
| 6,672,580 | B2 * | 1/2004 | Shibata et al. | 271/124 |
| 7,618,036 | B2 * | 11/2009 | Ikeda | 271/121 |
| 7,798,485 | B2 * | 9/2010 | Tu et al. | 271/125 |
| 8,424,867 | B2 * | 4/2013 | Morisaki | 271/121 |
| 8,905,398 | B2 * | 12/2014 | Kotaka | 271/121 |
| 2003/0062668 | A1 * | 4/2003 | Shibata et al. | 271/121 |
| 2004/0041332 | A1 * | 3/2004 | Kamimura et al. | 271/121 |
| 2006/0082043 | A1 | 4/2006 | Ikeda | |
| 2009/0315253 | A1 * | 12/2009 | Osakabe et al. | 271/121 |
| 2010/0258407 | A1 * | 10/2010 | Krause et al. | 198/443 |
| 2012/0080836 | A1 * | 4/2012 | Morisaki | 271/121 |
| 2012/0292846 | A1 * | 11/2012 | Kotaka | 271/10.09 |
| 2013/0293938 | A1 * | 11/2013 | Osakabe et al. | 358/498 |

FOREIGN PATENT DOCUMENTS

| | | | | |
|---|---|---|---|---|
| JP | 03026618 A | * | 2/1991 | B65H 3/06 |
| JP | 06092501 A | * | 4/1994 | B65H 3/52 |
| JP | 2006111397 A | | 4/2006 | |

* cited by examiner

*Primary Examiner* — Jeremy R Severson

(74) *Attorney, Agent, or Firm* — Merchant & Gould P.C.

(57) ABSTRACT

A sheet separating apparatus includes: a stacking part including a sheet support surface; a separation roller; a flexible member; a holding member to which a second end portion of the flexible member is fixed and urging the second end portion toward the separation roller; and an abutting part abuttable on the flexible member at an intermediate position. The flexible member includes an auxiliary support surface, provided upstream from the intermediate position, configured to support a downstream end portion of a sheet supported on the sheet support surface in a conveying direction and bendable in a direction getting away from the separation roller, and a friction surface provided downstream from the intermediate position and faces the separation roller to be contactable with the separation roller for separating the sheet one at a time in cooperation with the separation roller.

20 Claims, 9 Drawing Sheets

SHEET SEPARATING APPARATUS

CROSS-REFERENCE TO RELATED APPLICATIONS

This application claims priority from Japanese Patent Application No. 2014-072002 filed on Mar. 31, 2014, the entire subject-matter of which is incorporated herein by reference.

TECHNICAL FIELD

The disclosure relates to a sheet separating apparatus.

BACKGROUND

There has been proposed a sheet separating apparatus. The sheet separating apparatus includes a stacking part, a separation roller, a separation pad serving as a flexible member, and a holding member.

The stacking part has a sheet support surface configured to support a sheet. The separation roller is configured to contact the sheet, which is fed from the stacking part, from an opposite side to the sheet support surface and to convey the sheet toward a downstream side in a conveying direction. The separation pad has flexibility. The separation pad includes a moveable first end portion positioned upstream in the conveying direction and a second end portion positioned downstream in the conveying direction and configured to face the separation roller. The second end portion of the separation pad is attached to the holding member. The holding member is configured to urge the second end portion of the separation pad toward the separation roller.

More specifically, the separation pad has an auxiliary support surface at an upstream side in the conveying direction, i.e., at the first end portion-side. The auxiliary support surface is configured to support a downstream end portion of the sheet, which is supported on the sheet support surface, in the conveying direction and to be bendable in a direction getting away from the separation roller. Also, the separation pad has a friction surface at a downstream side in the conveying direction, i.e., at the second end portion-side. The friction surface is configured to face the separation roller so that it can contact the separation roller, and is configured to separate the sheet one at a time in cooperation with the separation roller.

However, according to the related-art sheet separating apparatus, as the number of stacked sheets supported on the sheet support surface increases, the auxiliary support surface of the separation pad is bent in the direction getting away from the separation roller. Thereby, the bending of the auxiliary support surface influences the friction surface, thereby deforming the friction surface. For this reason, according to the sheet separating apparatus, when the sheet fed from the stacking part is nipped by the separation roller and the friction surface of the separation pad, the nipped state, for example, an inclined angle of the friction surface of the separation pad relative to the separation roller or a pressing force thereof is varied, so that the separation performance may be deteriorated. As a result, problems such as multi feed of sheets and unloaded feed of the sheet may occur in the sheet separating apparatus.

SUMMARY

Therefore, illustrative aspects of the disclosure provide a sheet separating apparatus capable of exhibiting stable separation performance, irrespective of whether the number of stacked sheets supported on a sheet support surface is large or small.

In one aspect of the disclosure, a sheet separating apparatus comprises: a stacking part including a sheet support surface configured to support a sheet; a separation roller configured to convey the sheet supported on the sheet support surface toward a downstream side in a conveying direction; a flexible member having flexibility and comprising: a first end portion positioned upstream in the conveying direction and being displaceable; and a second end portion positioned downstream in the conveying direction and facing the separation roller, a first surface of the flexible member facing the separation roller; a holding member to which the second end portion of the flexible member is attached; and an abutting part configured to abut on a second surface, which is opposite to the first surface, of the flexible member at an intermediate position between the first end portion and the second end portion in the conveying direction, wherein the flexible member comprises: an auxiliary support surface provided upstream from the intermediate position in the conveying direction and configured to support a downstream end portion of the sheet supported on the sheet support surface in the conveying direction, wherein the auxiliary support surface is bendable in a direction getting away from the separation roller; and a friction surface provided downstream from the intermediate position in the conveying direction and configured to face the separation roller to be contactable with the separation roller, wherein the friction surface is configured to separate the sheet one at a time in cooperation with the separation roller.

BRIEF DESCRIPTION OF THE DRAWINGS

The present disclosure is illustrated, and not limited, by way of example by the accompanying figures in which like reference numerals indicate similar elements.

FIG. 5 is a partial perspective view of the image reading apparatus of the illustrative embodiment, which illustrates a feeder tray, a separation piece, a holding part, a film and the like;

FIG. 6 is an exploded perspective view of the image reading apparatus of the illustrative embodiment, which illustrates the feeder tray, the separation piece, the holding part, the film and the like;

DETAILED DESCRIPTION

Hereinafter, an illustrative embodiment will be described with reference to the drawings.

Figure 1:
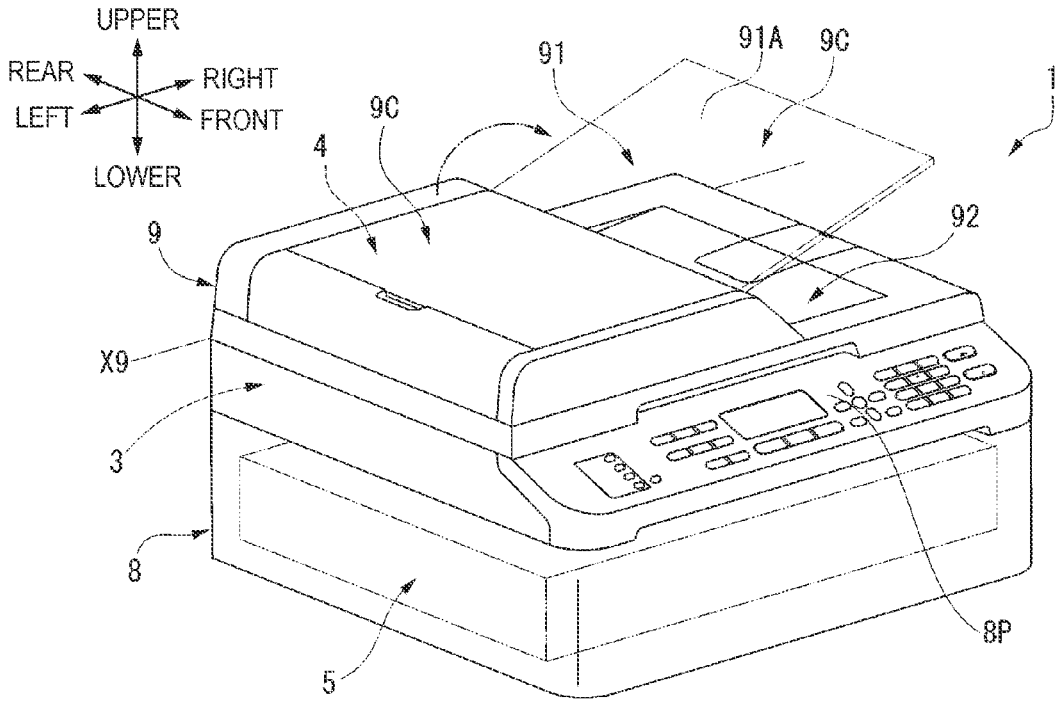
FIG. 1 is a perspective view of an image reading apparatus of an illustrative embodiment.

As shown in FIG. 1, an image reading apparatus 1 of an illustrative embodiment is an example of a specific aspect of the sheet separating apparatus of the disclosure. In FIG. 1, a side at which an operation panel 8P is defined as a front side of the apparatus and a left side on the basis of the operation panel 8P is defined as a left side, so that respective directions of front, rear, left, right, upper and lower are indicated. The respective directions denoted in FIG. 2 and thereafter are indicated in correspondence to the respective directions denoted in FIG. 1. Hereinafter, the respective constitutional elements of the image reading apparatus 1 will be described on the basis of FIG. 1 and the like.

<Configuration>

As shown in FIGS. 1 to 4, the image reading apparatus 1 includes a main body unit 8, an opening/closing unit 9, an image forming unit 5, a reading unit 3, a feeder tray 91, a discharge tray 92 and a conveyor 4. The main body unit 8 is a substantially flat box-shaped member. As shown in FIG. 1, a front surface of the main body unit 8 is provided with the operation panel 8P such as a touch panel.

Figure 2:
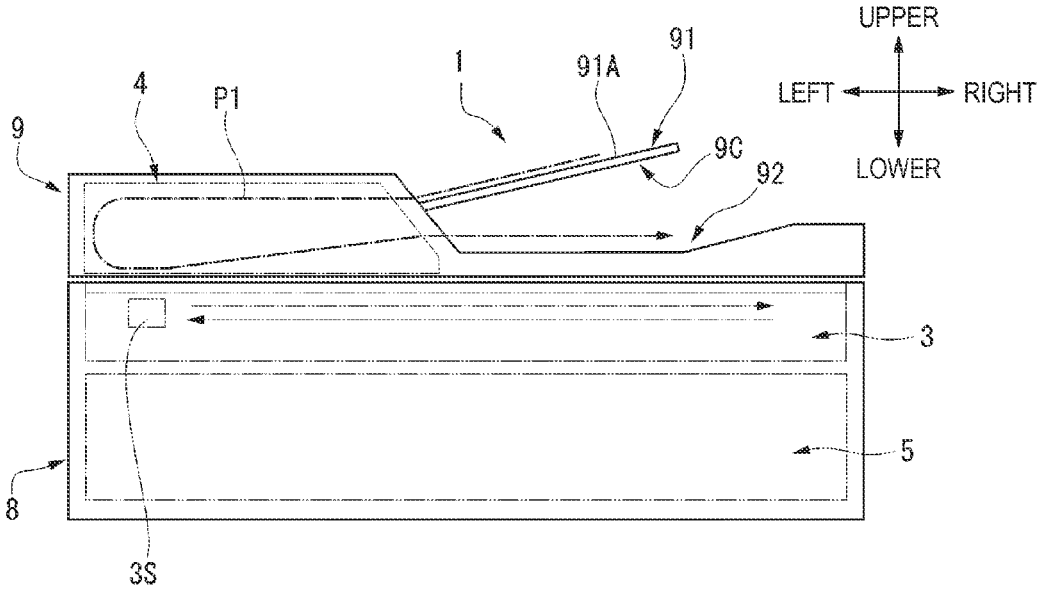
FIG. 2 is a pictorial front view of the image reading apparatus of the illustrative embodiment.

As shown in FIGS. 1 and 2, the image forming unit 5 is accommodated at a lower part in the main body unit 8. The image forming unit 5 is configured to form an image on a sheet by an inkjet or laser way. The reading unit 3 is accommodated at an upper part in the main body unit 8. The reading unit 3 is used when reading an image of a document.

Figure 4:
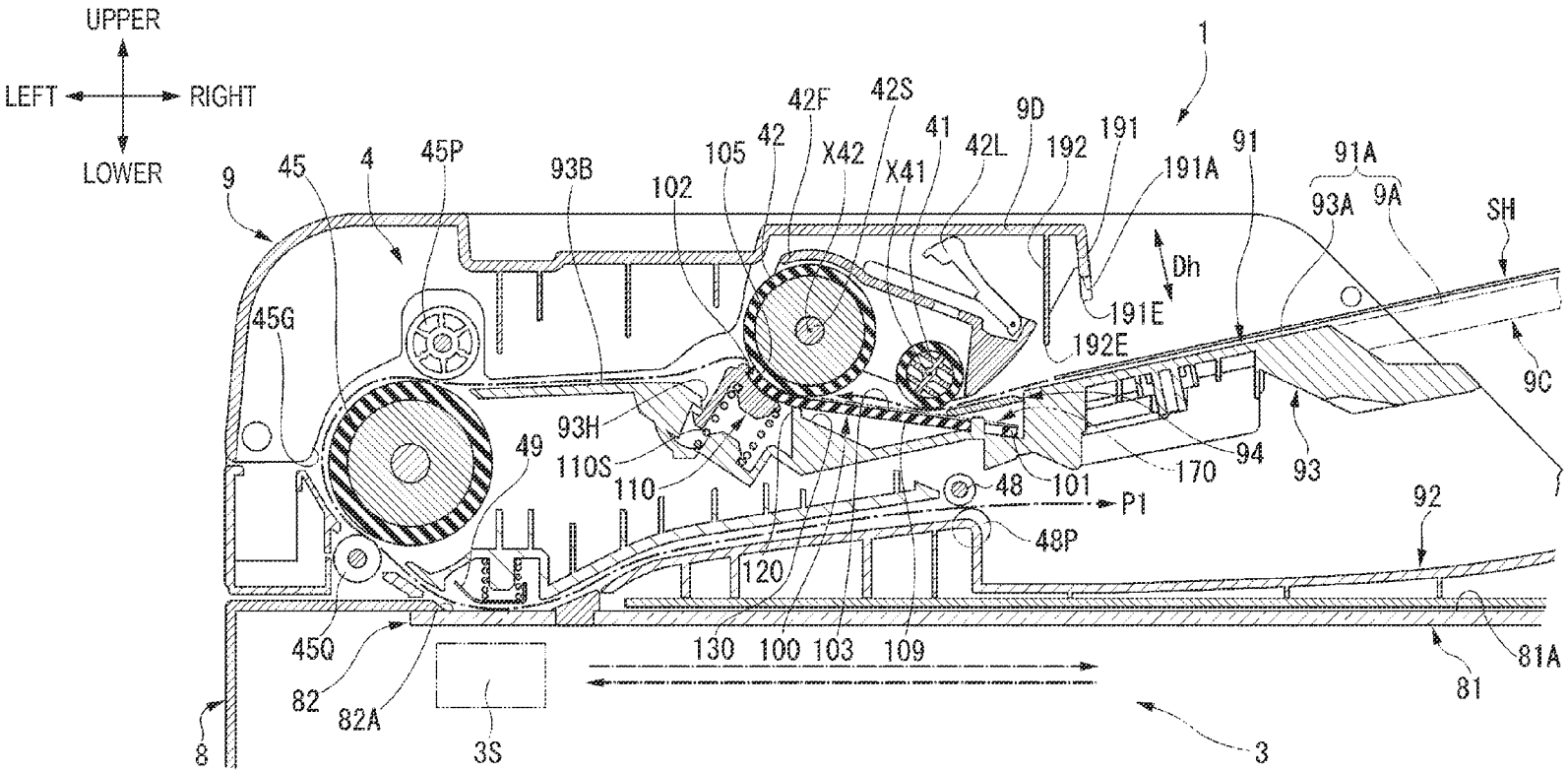
FIG. 4 is a pictorial partial sectional view of the image reading apparatus of the illustrative embodiment.

As shown in FIG. 4, a first platen glass 81 and a second platen glass 82 are arranged on an upper surface of the main body unit 8. An upper surface of the first platen glass 81 configures a document support surface 81A. The document support surface 81A supports a stationary document from below when the reading unit 3 reads an image of the document. The document to be read includes a sheet such as an OHP sheet, a book and the like. The second platen glass 82 is positioned at the left of the first platen glass 81 and is elongated in the front-rear direction. An upper surface of the second platen glass 82 configures a reading surface 82A. When the reading unit 3 reads an image of the sheet SH being conveyed one at a time by the conveyor 4, the reading surface 82A guides the sheet SH from below.

As shown in FIG. 1, the opening/closing unit 9 is swingably supported around an opening/closing shaft center X9 extending in the left-right direction by hinges (not shown) arranged at a rear-side upper end of the main body unit 8. At a closed state shown in FIGS. 1 to 4, the opening/closing unit 9 is configured to cover the document support surface 81A from above. Although not shown, the opening/closing unit 9 swings around the opening/closing shaft center X9 so that a front end portion-side thereof is displaced upward and rearward. Thereby, the opening/closing unit 9 is displaced to an opened position at which the document support surface 81A is exposed. Thereby, a user can make the document support surface 81A support a document which is a read target.

As shown in FIG. 4, the reading unit 3 includes a reading sensor 3S accommodated at an upper part in the main body unit 8 and a scanning mechanism (not shown). The reading sensor 3S is an example of the 'reading unit' of the disclosure. The scanning mechanism is configured to reciprocally move the reading sensor 3S in the left-right direction below the document support surface 81A and the reading surface 82A in the main body unit 8. As the reading sensor 3S, a well-known image reading sensor such as a CIS (Contact Image Sensor) and a CCD (Charge Coupled Device) may be used.

Figure 3:
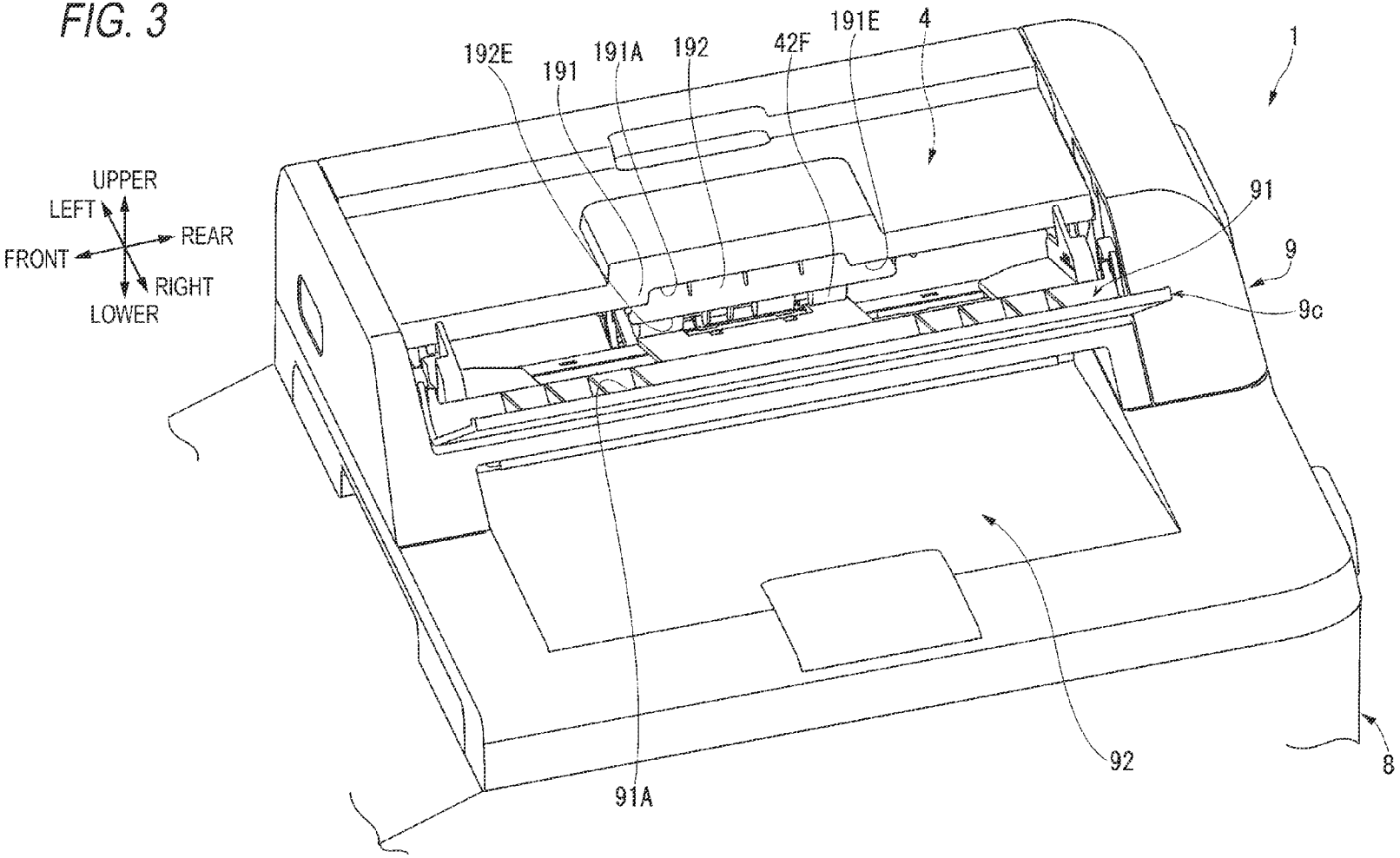
FIG. 3 is a partial perspective view of an opening/closing unit of the image reading apparatus of the illustrative embodiment.

As shown in FIGS. 2 to 4, the conveyor 4 is provided at the opening/closing unit 9. The conveyor 4 includes the feeder tray 91 and the discharge tray 92. The feeder tray 91 is an example of the 'stacking part' of the disclosure. The feeder tray 91 is formed at a right part of the opening/closing unit 9 by opening a closed cover 9C shown with a solid line in FIG. 1, as shown with a dashed-two dotted line in FIG. 1.

Also, as shown in FIG. 4, the feeder tray 91 is formed by the opened cover 9C and a chute member 93 positioned downstream from the cover 9C in a conveying direction. An upper surface of the cover 9C configures a part of a sheet support surface 91A. The sheet support surface 91A is configured to support a plurality of sheets SH, which are to be conveyed by the conveyor 4 and are reading targets, from below at a stacked state. The sheet support surface 91A is formed by a first sheet support surface 9A, which is an upwardly facing surface of the opened cover 9C, and a second sheet support surface 93A, which is a right part of an upper surface of the chute member 93. The sheet support surface 91A is a flat surface inclined leftward and downward. In this illustrative embodiment, a height direction orthogonal to the sheet support surface 91A is a direction Dh indicated in FIGS. 4 and 7 to 9. The height direction Dh is inclined relative to a vertical direction.

As shown in FIGS. 1 to 4, the discharge tray 92 is positioned below the feeder tray 91 and is arranged to overlap vertically with the same. The sheet SH of which an image has been read by the reading sensor 3S and has been discharged by the conveyor 4 is stacked on the discharge tray 92.

As shown in FIGS. 2 and 4, the conveyor 4 defines a conveyance path P1, as a space surrounded by guide surfaces extending to be contactable to one surface and the other surface of the sheet SH, conveying rollers (which will be described later) and the like. The conveyance path P1 includes a part extending substantially horizontally leftward from a downstream end portion of the sheet support surface 91A of the feeder tray 91 in the conveying direction. Then, the conveyance path P1 includes a downwardly curved part. Then, the conveyance path P1 includes a part extending shortly rightward along the reading surface 82A. Finally, the conveyance path P1 includes a part inclined rightward and upward from a downstream side of the reading surface 82A in the conveying direction and reaching the discharge tray 92.

A conveying direction of the sheet SH that is conveyed by the conveyor 4 is a leftward direction on the substantially horizontal upper part of the conveyance path P1, is changed from the leftward direction to a rightward direction on the downwardly curved part of the conveyance path P1 and is a rightward direction on the lower part of the conveyance path P1 passing through the reading surface 82A and reaching the discharge tray 92. In the meantime, the extending directions and shapes of the conveyance path P1 are just exemplary.

As shown in FIGS. 4 to 9, the conveyor 4 includes the chute member 93, a supply roller 41, a separation roller 42, a separation piece 100, a holding part 110, an abutting part 120, an inclined surface 130 and a film 170. The separation piece 100 is an example of the 'flexible member' of the disclosure. The inclined surface 130 is an example of the 'restraint part' of the disclosure.

Figure 5:
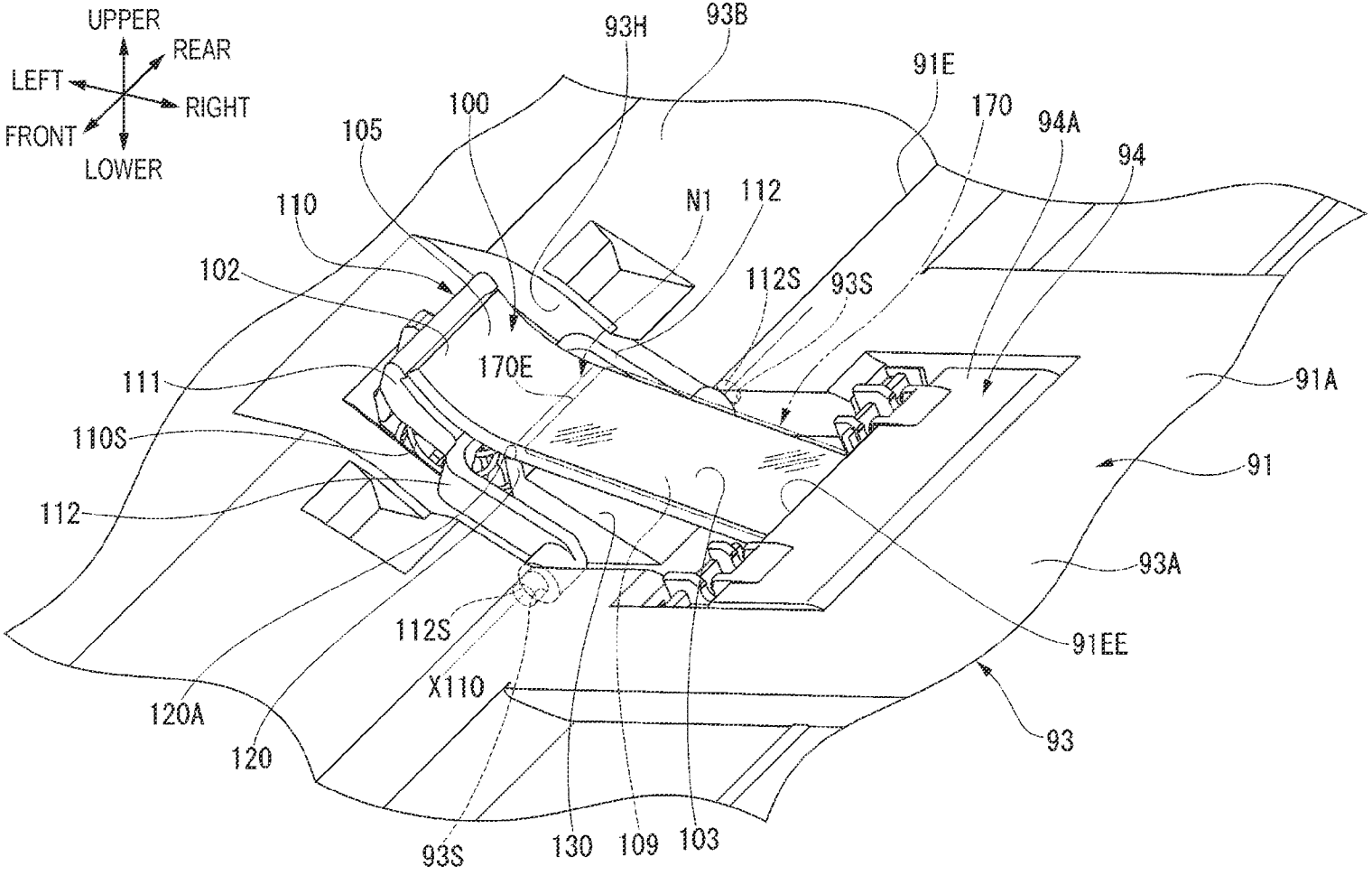
Figure 6:
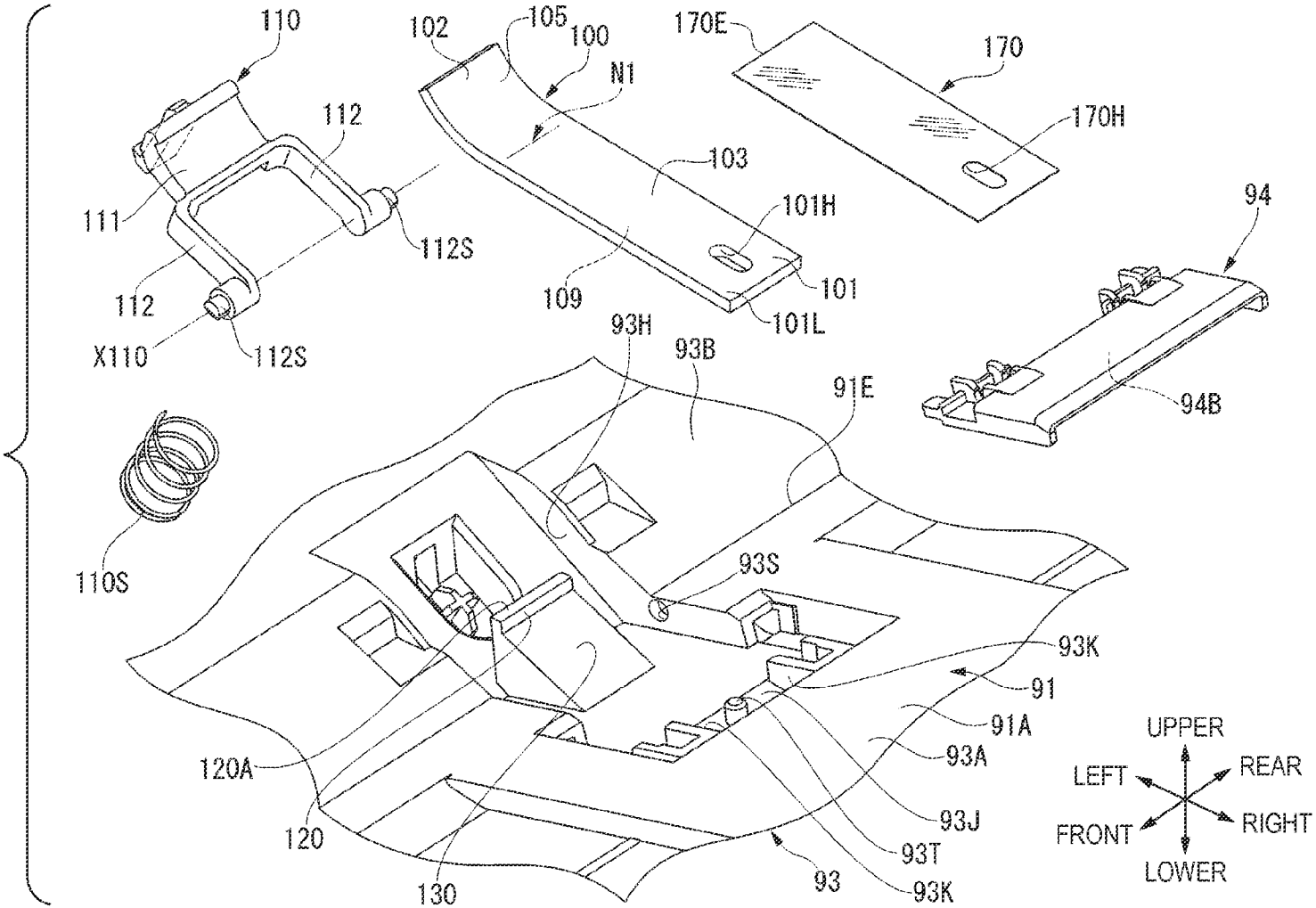

As shown in FIG. 4, the chute member 93 is a resin-molded product of which an upper surface has a substantially flat plate shape. An area of the upper surface of the chute member 93 positioned at the left of the second sheet support surface 93A is configured as a guide surface 93B. More specifically, as shown in FIGS. 5 and 6, a right end portion of the guide surface 93B connects to a downstream end portion 91E of the sheet support surface 91A in the conveying direction, i.e., to a left end portion of the second sheet support surface 93A. The guide surface 93B is inclined leftward and upward from the right end portion thereof and then extends substantially horizontally. As shown in FIG. 4, the guide surface 93B forms a flat surface that may abut on the sheet SH, which is fed from the feeder tray 91, from below. The guide surface 93B defines the substantially horizontal upper part of the conveyance path P1 from below.

The separation roller 42 is provided to face the guide surface 93B from above at a left position of the downstream end portion 91E of the sheet support surface 91A in the conveying direction. The separation roller 42 is mounted to a driving shaft 42S having a shaft center X42 extending in the front-rear direction, as a central axis. The separation roller 42 is a roller configured to rotate around the shaft center X42 together with the driving shaft 42S. That is, the separation roller 42 is provided to contact the sheet SH, which is fed from the feeder tray 91, from an opposite side to the sheet support surface 91A.

A holder 42F is supported to the driving shaft 42S so that the holder 42F may swing around the shaft center X42. The holder 42F protrudes rightward from the driving shaft 42S.

The supply roller 41 is provided at a position at which it faces the second sheet support surface 93A of the chute member 93 from above at the right of the separation roller 42, i.e., at the upstream side of the separation roller 42 in the conveying direction. The supply roller 41 is supported to a right part of the holder 42F so that it may rotate around a shaft center X41 extending in the front-rear direction. That is, the supply roller 41 is provided to contact the sheet SH, which is supported on the sheet support surface 91A of the feeder tray 91, from an opposite side to the sheet support surface 91A. Although not shown, the holder 42F is provided with a transmission gear group (not shown) configured to transmit a rotational driving force from the driving shaft 42S to the supply roller 41.

As shown in FIGS. 4 and 7 to 9, the holder 42F is provided with an urging lever 42L. An urging spring (not shown) is provided between the urging lever 42L and the holder 42F. When an upper end portion of the urging lever 42L is urged to the urging spring and is pressed to an inner surface of an upper wall 9D of the opening/closing unit 9, the holder 42F swings around the shaft center X42 to bring the supply roller 41 close to the sheet support surface 91A. Thereby, the supply roller 41 is enabled to come close to and to separate from the sheet support surface 91A, depending on the number of the sheets SH supported on the sheet support surface 91A, and is thus contacted to the uppermost sheet SH.

The supply roller 41 is configured to rotate around the shaft center X41 to apply a conveying force to the uppermost sheet SH of the plurality of sheets SH supported on the sheet support surface 91A of the feeder tray 91, thereby supplying the corresponding sheet SH toward the separation roller 42. The separation roller 42 is configured to rotate with contacting the sheet SH, which is fed from the supply roller 41, i.e., from an upstream side in the conveying direction, thereby conveying the sheet SH leftward along the substantially horizontal upper part of the conveyance path P1, i.e., toward a downstream side in the conveying direction.

Here, as shown in FIGS. 3 and 4, a right end portion of the upper wall 9D of the opening/closing unit 9 is formed with a first wall part 191 and a second wall part 192.

The first wall part 191 protrudes downwardly from a right end of the upper wall 9D and extends in the front-rear direction. A central portion of the first wall part 191 in the front-rear direction is formed with a hand grip part 191A recessed upwardly. When opening the upper wall 9D for maintenance, a user may easily pull up the right end portion of the upper wall 9D with putting a hand on the hand grip part 191A.

The second wall part 192 protrudes downwardly from a position of the left of the first wall part 191 (a downstream side in the conveying direction) and the right of the holder 42F and extends in the front-rear direction. A lower end 192E of the second wall part 192 is located at a position lower than a lower end 191E of the first wall part 191 and is closer to the sheet support surface 91A. An interval between the lower end 192E of the second wall part 192 and the sheet support surface 91A is set so that a predetermined number of sheets may be inserted in the apparatus of the disclosure and foreign materials are prevented from being introduced therein.

By the first wall part 191 and the second wall part 192, it is possible to prevent the foreign materials from being introduced in the vicinities of the holder 42F and the supply roller 41 while increasing the number of stacked sheets SH supported on the sheet support surface 91A.

As shown in FIGS. 5 and 6, the chute member 93 has an opening 93H. The opening 93H is recessed in a direction getting away from the separation roller 42, i.e., in a downward direction at the downstream end portion 91E-side of the sheet support surface 91A in the conveying direction. The opening 93H includes at least a part of an area of the sheet support surface 91A facing the separation roller 42. Also, the opening 93H includes a part extending leftward beyond the end portion 91E of the sheet support surface 91A and biting into the guide surface 93B, and a part extending rightward beyond the end portion 91E and biting into the second sheet support surface 93A. A right area of the opening 93H, which is formed at the second sheet support surface 93A-side, is longer than the other areas in the front-rear direction.

As shown in FIG. 5, the chute member 93 includes a small piece 94. As shown in FIG. 6, the chute member 93 is formed with a recess portion 93J. The recess portion 93J is positioned at a right end portion in the opening 93H. As shown in FIGS. 5 and 6, the small piece 94 is configured to be mounted to the chute member 93 so as to cover the recess portion 93J from above and to be removable. As shown in FIGS. 5 and 7 to 9, an upper surface 94A of the small piece 94 forms a part of the sheet support surface 91A at the downstream side. A lower surface 94B of the small piece 94 extends in the left-right direction at a vertical interval from a bottom surface of the recess portion 93J. The lower surface 94B of the small piece 94 is an example of the 'opposite surface of the feeder tray to the sheet support surface' of the disclosure.

As shown in FIG. 5, a left end of the small piece 94 configures an end portion 91EE, which is a part of the downstream end portion 91E of the sheet support surface 91A in the conveying direction. That is, the end portion 91EE, which faces the opening 93H, of the downstream end portion 91E of the sheet support surface 91A in the conveying direction is positioned at the right of the other part of the end portion 91E, i.e., at the upstream side in the conveying direction.

As shown in FIGS. 5 and 6, front and rear inner wall surfaces of the opening 93H are provided with a pair of front and rear recessed bearing parts 93S, 93S. Each of the bearing parts 93S, 93S is positioned in the vicinity of the end portion 91E of the sheet support surface 91A.

The abutting part 120 and the inclined surface 130 are formed integrally with the chute member 93 together with the sheet support surface 91A.

Figure 7:
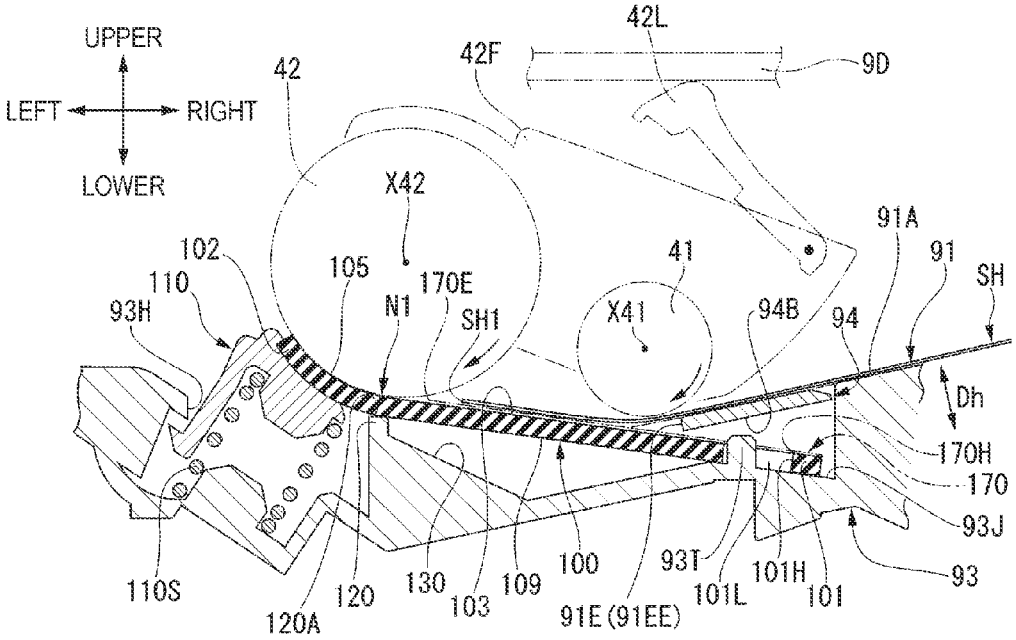
FIG. 7 is a pictorial view of the image reading apparatus of the illustrative embodiment, which illustrates operations of an abutting part, an auxiliary support surface and a friction surface.
Figure 8:
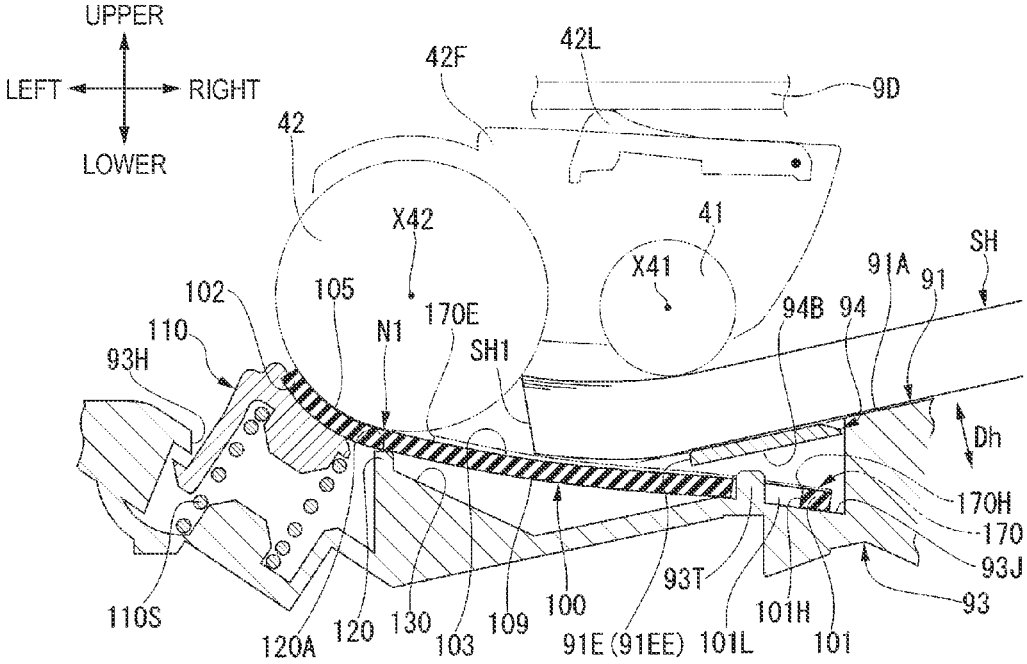
FIG. 8 is a pictorial view of the image reading apparatus of the illustrative embodiment, which illustrates operations of the abutting part, the auxiliary support surface and the friction surface.
Figure 9:
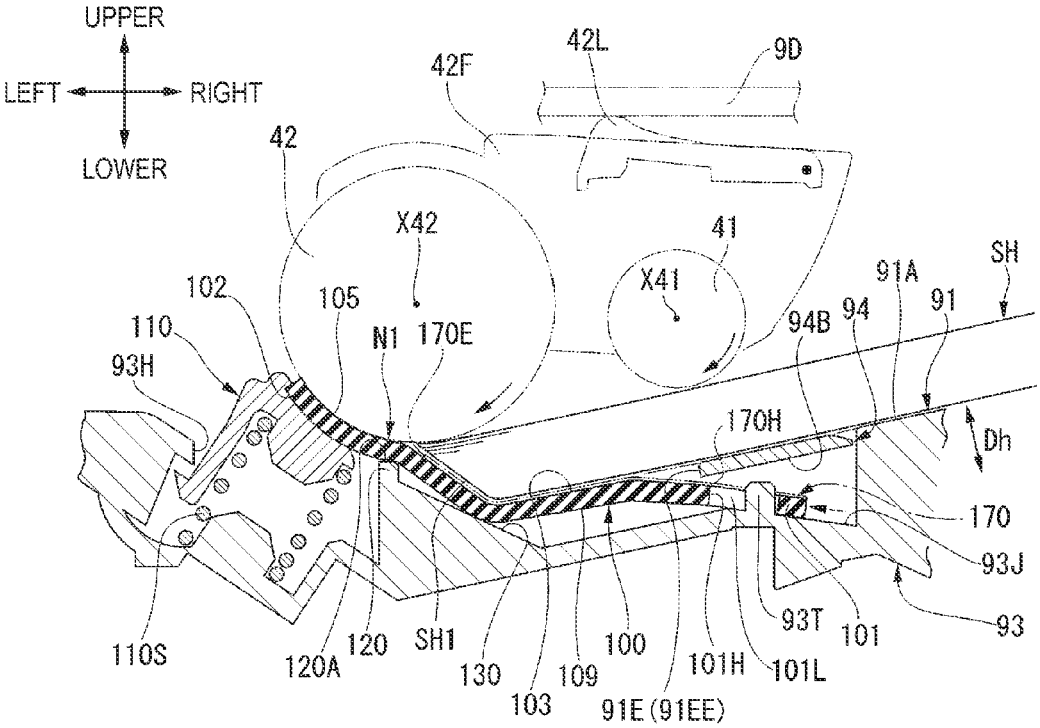
FIG. 9 is a pictorial view of the image reading apparatus of the illustrative embodiment, which illustrates operations of the abutting part, the auxiliary support surface and the friction surface.

The abutting part 120 is a rib protruding upwardly from a bottom of the opening 93H. An upper end 120A of the abutting part 120 extends in the front-rear direction. As shown in FIGS. 7 to 9, the upper end 120A of the abutting part 120 is configured to face the separation roller 42 from below. The upper end 120A of the abutting part 120 is located at a slight left position just below the shaft center X42 of the separation roller 42.

The inclined surface 130 is formed integrally with the abutting part 120 and is positioned at the right of the abutting part 120, i.e., at the upstream side in the conveying direction. The inclined surface 130 is inclined rightward and downward from a position lower than the upper end 120A of the abutting part 120. In other words, the inclined surface 130 is inclined to be more spaced from the separation roller 42 as it faces upstream in the conveying direction.

As shown in FIGS. 5 to 9, the separation piece 100 is flexible. In this illustrative embodiment, the separation piece 100 is a rectangular plate member made of rubber. The separation piece 100 extends in the left-right direction below the separation roller 42. The separation piece 100 includes a first end portion 101 and a second end portion 102.

The first end portion 101 is a right end portion of the separation piece 100 and the second end portion 102 is a left end portion of the separation piece 100. In other words, the first end portion 101 of the separation piece 100 is positioned upstream in the conveying direction, and the second end portion 102 is positioned downstream in the conveying direction.

As shown in FIG. 6, the first end portion 101 of the separation piece 100 is formed with a long hole 101H penetrating in the upper-lower direction. The long hole 101H extends in the left-right direction. A cylindrical protrusion 93T protrudes from a center of the bottom of the recess portion 93J of the chute member 93.

As shown in FIGS. 7 to 9, the first end portion 101 of the separation piece 100 is configured to abut on the bottom of the recess portion 93J from above with the protrusion 93T being inserted into the long hole 101H. By this configuration, the first end portion 101 of the separation piece 100 may move in the left-right direction. The first end portion 101 of the separation piece 100 is positioned at the lower surface 94B of the small piece 94. More specifically, the first end portion 101 of the separation piece 100 includes a part 101L that gets into a below of the lower surface 94B of the small piece 94, extends toward the right end of the opening 93H, i.e., the upstream side in the conveying direction and is arranged with overlapping with the feeder tray 91 in the direction Dh orthogonal to the sheet support surface 91A. That is, the first end portion 101 of the separation piece 100 is restrained from being pulled out from the protrusion 93T by the small piece 94 configured to cover the recess portion 93J. As shown in FIG. 6, the recess portion 93J includes front and rear inner wall surfaces 93K. The first end portion 101 of the separation piece 100 is restrained from positionally deviating in the front-rear direction by the front and rear inner wall surfaces 93K shown in FIG. 6.

As shown in FIGS. 4 and 7 to 9, the second end portion 102 of the separation piece 100 extends up to the left of the shaft center X42 of the separation roller 42 and is configured to face the separation roller 42 from below. The second end portion 102 of the separation piece 100 is fixed to the holding member 110.

As shown in FIGS. 7 to 9, the upper end 120A of the abutting part 120 is configured to abut on the separation piece 100 from below, i.e., from the opposite side to the separation roller 42 at an intermediate position N1 between the right first end portion 101 of the separation piece 100 and the left second end portion 102 of the separation piece 100. Here, a height of the upper end 120A of the abutting part 120 is set to secure a gap between the separation roller 42 and the separation piece 100 at the intermediate position N1 so that the sheet SH can pass therethrough.

As shown in FIGS. 5 and 6, the holding member 110 is a resin-molded product having a base part 111 and a front protrusions 112 and a rear protrusions 112.

The base part 111 has a substantially rectangular plate shape. The base part 111 is curved to conform to an outer peripheral surface of the separation roller 42. The second end portion 102 of the separation piece 100 is attached to an upper surface of the base part 111 by a double-sided tape, and the like. That is, the second end portion 102 of the separation piece 100 is attached to the holding member 110.

The front protrusion 112 protrudes forwardly from a front-right angled part of the base part 111, is bent and protrudes rightward. The rear protrusion 112 protrudes rearward from a rear-right angled part of the base part 111, is bent and protrudes rightward. Right end portions of the respective protrusions 112, 112 are formed with shaft parts 112S, 112S. The front shaft part 112S and the rear shaft part 112S are cylindrical shaft members each of which has a swinging shaft center X110 extending in the front-rear direction, as a central axis. The front shaft part 112S and the rear shaft part 112S protrude in directions getting away from each other. As shown in FIG. 5, the swinging shaft center X110 is positioned in the vicinity of the end portion 91E of the sheet support surface 91A.

As shown in FIG. 6, the respective shaft parts 112S, 112S of the holding member 110 are fitted in the respective bearing parts 93S, 93S of the chute member 93, so that the holding member 110 is supported to the chute member 93 to be swingable around the swinging shaft center X110. By this configuration, the base part 111 of the holding member 110 may come close to and separate from the separation roller 42 by vertically moving at the left of the abutting part 120.

As shown in FIGS. 4 to 6, a compression coil spring 110S is arranged between the base part 111 of the holding member 110 and the bottom of the opening 93H of the chute member 93. The compression coil spring 110S is configured to urge the base part 111 upwardly, so that the second end portion 102 of the separation piece 100 is urged toward the separation roller 42.

As shown in FIGS. 5 to 9, the separation piece 100 has an auxiliary support surface 103 and a friction surface 105. The auxiliary support surface 103 is a part of n upper surface of the separation piece 100, which is positioned at the right of the intermediate position N1, i.e., at an upstream side in the conveying direction. The friction surface 105 is a part of the upper surface of the separation piece 100, which is positioned at the left of the intermediate position N1, i.e., at a downstream side in the conveying direction. As shown in FIG. 5, the second end portion 102 of the separation piece 100 is attached to the holding member 110 with the auxiliary support surface 103 and the friction surface 105 being exposed from the opening 93H.

As shown in FIGS. 5 and 7 to 9, the auxiliary support surface 103 extends toward the separation roller 42 from a vicinity of the end portion 91EE, which faces toward the opening 93H, of the downstream end portion 91E of the sheet support surface 91A in the conveying direction. The auxiliary support surface 103 can be bent in a direction getting away from the separation roller 42, i.e., downwardly between the first end portion 101 and the abutting part 120. A surface of the separation piece 100 facing toward an opposite side to the auxiliary support surface 103 is configured as a restrained surface 109.

As shown in FIG. 7, the inclined surface 130 is configured to face the restrained surface 109 from below at an interval in the upper-lower direction. As shown in FIG. 9, the inclined surface 130 abuts on the restrained surface 109 to restrain a bending range of the auxiliary support surface 103 when the bending of the auxiliary support surface 103 becomes large. At this time, the restrained surface 109 conforms to and abuts on the inclined surface 130, so that an inclined angle of the auxiliary support surface 103 is restrained from being excessively large.

As shown in FIG. 6, regarding the film 170, a resin sheet having high stiffness and smooth surface such as a polyester film is used. A right end portion of the film 170 is formed with a long hole 170H penetrating therethrough. As shown with a dashed-two dotted line in FIG. 5, the film 170 extends leftward along the auxiliary support surface 103, i.e., toward the downstream side in the conveying direction from a vicinity of the end portion 91EE, which faces toward the opening 93H, of the downstream end portion 91E of the sheet support surface 91A in the conveying direction. The film 170 may be attached to the auxiliary support surface 103 by a double-sided tape, and the like.

As shown in FIGS. 7 to 9, the film 170 is configured to abut on the separation piece 100 from above with the protrusion 93T protruding from the recess portion 93J of the chute member 93 being inserted in the long hole 170H. The right end portion of the film 170 is restrained from being pulled out from the protrusion 93T by the small piece 94 configured to cover the recess portion 93J. The right end portion 101 of the film 170 is restrained from positionally deviating in the front-rear direction by the front and rear inner wall surfaces 93K of the recess portion 93J shown in FIG. 6. By this configuration, the right end portion of the film 170 may move in the left-right direction together with the first end portion 101 of the separation piece 100.

As shown in FIGS. 5 and 7 to 9, a downstream tip end 170E of the film 170 in the conveying direction is located at the right of the friction surface 105 and the abutting part 120, i.e., at an upstream side in the conveying direction.

As shown in FIGS. 7 to 9, the auxiliary support surface 103 is configured to support a downstream end portion SH1 of the sheet SH in the conveying direction, which is supported on the sheet support surface 91A, with the film 170 being interposed. At this time, as shown in FIG. 7, when the number of stacked sheets SH is small, the auxiliary support surface 103 is not bent so much. On the other hand, as shown in FIG. 8, when the number of stacked sheets SH is large, the downstream end portions SH1 of the sheets SH in the conveying direction are contacted to a high position (a position distant from the separation piece 100) of the outer peripheral surface of the separation roller 42. At this time, the auxiliary support surface 103 is pushed by the sheets SH and is thus bent downwardly. As shown in FIG. 9, when the supply roller 41 and the separation roller 42 are rotated, a downward force is applied to the end portions SH1 of the sheets SH from the separation roller 42 and the auxiliary support surface 103 is further bent downwardly by the downward force. As a result, as can be seen from a comparison of FIGS. 7 and 9, a trajectory along which the uppermost sheet SH supported on the sheet support surface 91A faces toward a gap between the separation roller and the separation piece at the intermediate position N1 is stable, irrespective of whether the number of sheets SH supported on the sheet support surface 91A is large or small. At this time, since the end portion SH1 of the sheet SH supported on the auxiliary support surface 103 is contacted to the auxiliary support surface 103 with the flat film 170 being interposed, the sheet SH can be prevented from being caught at the auxiliary support surface 103.

The friction surface 105 is formed by the surface of the rubber plate material configuring the entire separation piece 100. When the second end portion 102 of the separation piece 100 is urged toward the separation roller 42 by the holding member 110 and the compression coil spring 110S, the friction surface 105 is bent downwardly between the abutting part 120 and the second end portion 102 and is pressed to the outer peripheral surface of the separation roller 42. When the plurality of sheets SH is conveyed from the supply roller 41 to the separation roller 42 with being stacked, the separation piece 100 separates the sheets one at a time in cooperation with the separation roller 42 and the friction surface 105.

As shown in FIG. 4, the conveyor 4 includes a large diameter conveying roller 45, a curved guide surface 45G and pinch rollers 45P, 45Q at the downwardly curved part of the conveyance path P1. An outer peripheral surface of the conveying roller 45 is configured to form an inner guide surface of the downwardly curved part of the conveyance path P1. The curved guide surface 45G is arranged at a predetermined interval from the outer peripheral surface of the conveying roller 45. The curved guide surface 45G is configured to form an outer guide surface of the downwardly curved part of the conveyance path P1. The conveying roller 45 is configured to convey the sheet SH toward the reading surface 82A in cooperation with the pinch rollers 45P, 45Q abutting on the outer peripheral surface of the conveying roller 45.

The conveyor 4 includes a pressing member 49 at a position facing the reading surface 82A from above. The pressing member 49 is configured to press the sheet SH, which is being conveyed from the conveying roller 45, from above, thereby bringing the same into contact with the reading surface 82A.

The conveyor 4 includes a discharge roller 48 and a pinch roller 48P at the upwardly inclined part of the conveyance path P1 at the right of the pressing member 49. The discharge roller 48 and the pinch roller 48P are configured to face toward the discharge tray 92. The discharge roller 48 and the pinch roller 48P are configured to discharge the sheet SH having passed above the reading surface 82A toward the discharge tray 92.

<Image Reading Operation>

According to the image reading apparatus 1, when reading an image of a document supported on the document support surface 81A, the scanning mechanism (not shown) of the reading unit 3 is operated to move the reading sensor 3S in the left-right direction between a lower position of a left end of the document support surface 81A and a lower position of a right end thereof. Thereby, the reading sensor 3S reads the image of the document supported on the document support surface 81A. Thereafter, the scanning mechanism (not shown) returns the reading sensor 3S having completed the reading to the original position by moving the same from the right end to the left end in the reading unit 3.

Also, according to the image reading apparatus 1, when reading an image of the sheet SH on the feeder tray 91, the scanning mechanism (not shown) of the reading unit 3 is operated to stop the reading sensor 3S at a predetermined reading position of the reading surface 82A. The reading sensor 3B located at the predetermined reading position is positioned downstream from the separation roller 42 in the conveying direction. When the conveyor 4 sequentially conveys the sheets SH on the feeder tray 91 along the conveyance path P1, the sheet SH passes above the reading sensor 3S located at the predetermined reading position with contacting the reading surface 82A. Therefore, the reading sensor 3S reads an image of the passing sheet SH. Then, the sheet SH of which an image has been read is discharged to the discharge tray 92 by the discharge roller 48 and pinch roller 48P.

According to the image reading apparatus 1 of the illustrative embodiment, as shown in FIGS. 7 to 9, the upper end 120A of the abutting part 120 is configured to abut on the separation piece 100 from below, i.e., from the opposite side to the separation roller 42 at the intermediate position N1 between the first end portion 101 and the second end portion 102 in the conveying direction. The separation piece 100 has the auxiliary support surface 103 at the upstream side from the intermediate position N1 in the conveying direction. The separation piece 100 has the friction surface 105 at the downstream side from the intermediate position N1 in the conveying direction. That is, the upper end 120A of the abutting part 120 is configured to abut on the separation piece 100 between the auxiliary support surface 103 and the friction surface 105, thereby restraining the auxiliary support surface 103 and the friction surface 105 from influencing each other. Thereby, according to the image reading apparatus 1, as shown in FIG. 9, when the number of stacked sheets SH supported on the sheet support surface 91A increases, the auxiliary support surface 103 of the separation piece 100 is appropriately bent downwardly, i.e., toward the direction getting away from the separation roller 42, thereby suppressing a positional relation between the sheet SH and the separation roller 42 from being a position unsuitable for the conveyance of the sheet SH. Thereby, according to the image reading apparatus 1, it is possible to suppress a problem in the conveyance of the sheet SH. Also, according to the image reading apparatus 1, the abutting part 120 is provided. Therefore, the positional relation between the separation roller 42 and the separation piece 100 is held to a position suitable for the separation of the sheets SH. For this reason, according to the image reading apparatus 1, even when the auxiliary support surface 103 of the separation piece 100 is bent in the direction getting away from the separation roller 42, it is possible to suppress the bending of the auxiliary support surface 103 from displacing the friction surface 105 in the direction getting away from the separation roller 42 or from deforming the friction surface 105. For this reason, according to the image reading apparatus 1, a nipped state between the separation roller 42 and the friction surface 105 of the separation piece 100, for example, an inclined angle of the friction surface 105 of the separation piece 100 relative to the separation roller 42 or a pressing force thereof is hardly varied. As a result, according to the image reading apparatus 1, it is possible to separate the sheets SH, which are fed from the feeder tray 91, with high precision between the separation roller 42 and the friction surface 105 of the separation piece 100.

Therefore, according to the image reading apparatus 1 of the illustrative embodiment, it is possible to exhibit the stable separation performance, irrespective of whether the number of stacked sheets SH supported on the sheet support surface 91A is large or small. As a result, it is possible to reduce problems such as multi feed of sheets SH and unloaded feed of the sheet in the image reading apparatus 1.

Also, according to the image reading apparatus 1, the entire separation piece 100 is formed of the rubber, which is a frictional material configuring the friction surface 105. For this reason, according to the image reading apparatus 1, it is possible to simplify the separation piece 100 and to save the manufacturing cost of the separation piece 100.

Further, according to the image reading apparatus 1, as shown in FIG. 5, the second end portion 102 of the separation piece 100 is attached to the holding member 110 with the auxiliary support surface 103 and the friction surface 105 being exposed from the opening 93H. Thereby, according to the image reading apparatus 1, it is possible to easily implement a configuration enabling the auxiliary support surface 103 of the separation piece 100 to be bent in the direction getting away from the separation roller 42.

Also, according to the image reading apparatus 1, as shown in FIGS. 7 to 9, the first end portion 101 includes the part 101L that gets into the below of the opposite surface of the feeder tray 91 to the sheet support surface 91A, i.e., the lower surface 94B of the small piece 94, extends toward the right end side of the opening 93H, i.e., the upstream side in the conveying direction and is arranged with overlapping with the feeder tray 91 in the direction Dh orthogonal to the sheet support surface 91A. For this reason, according to the image reading apparatus 1, even when the first end portion 101 is moved leftward from the position shown in FIG. 7, as shown in FIG. 9, as the auxiliary support surface 103 is bent, the state where the first end portion 101 is covered by the lower surface 94B of the small piece 94 is kept. For this reason, according to the image reading apparatus 1, it is possible to prevent a situation where the first end portion 101 is pulled out toward the separation roller 42 and the separation piece 100 is thus rolled up.

Further, according to the image reading apparatus 1, as shown in FIG. 9, the inclined surface 130 serving as the restraint part is configured to abut on the restrained surface 109, thereby restraining the bending range of the auxiliary support surface 103 and the inclined angle of the auxiliary support surface 103 from being excessively large. For this reason, according to the image reading apparatus 1, it is possible to suppress the auxiliary support surface 103 from being excessively bent to deform the friction surface 105. Also, according to the image reading apparatus 1, it is possible to suppress the auxiliary support surface 103 from being excessively bent or the inclined angle from being excessively large and the sheet SH from being thus caught at the auxiliary support surface 103. As a result, according to the image reading apparatus 1, it is possible to securely suppress the deterioration of the separation performance. Also, since the inclined surface 130 is shaped in conformity to the bent shape of the auxiliary support surface 103, the inclined surface 130 may more easily exhibit the function of the restraint part.

Further, according to the image reading apparatus 1, as shown in FIG. 6, the abutting part 120, which is a rib, and the inclined surface 130 are formed integrally with the chute member 93, together with the sheet support surface 91A. For this reason, according to the image reading apparatus 1, it is possible to simplify a mounting operation, as compared to a configuration where the abutting part 120 and the inclined surface 130 are configured as separate members from the chute member 93 configuring the feeder tray 91. Also, according to the image reading apparatus 1, the abutting part 120 and the inclined surface 130 are formed integrally with the chute member 93, so that it is possible to arrange the abutting part 120 and the inclined surface 130 at stable positions with respect to the separation roller 42.

Also, according to the image reading apparatus 1, as shown in FIGS. 7 to 9, the sheet SH supported on the auxiliary support surface 103 is conveyed downstream in the conveying direction with sliding-contacting the film 170 on which the sheet may easily slide. For this reason, according to the image reading apparatus 1, even when the auxiliary support surface 103 is bent, the sheet SH can be prevented from being caught at the auxiliary support surface 103. Also, since the downstream tip end 170E of the film 170 in the conveying direction is positioned upstream from the friction surface 105 in the conveying direction, the film 170 has difficulty in influencing the separation performance.

Further, according to the image reading apparatus 1, the separation roller 42 and the friction surface 105 of the separation piece 100 exhibit the stable separation performance, so that it is possible to stabilize a reading quality of the reading sensor 3S configured to read an image of the separated sheet SH.

Although the disclosure has been described with reference to the illustrative embodiment, the disclosure is not limited to the illustrative embodiment and can be appropriately changed without departing from the gist thereof.

For example, regarding the material configuring the friction surface, a frictional material such as rubber, elastomer, sponge and the like may be adopted. The flexible member may be configured by bonding a frictional material configuring a friction surface to a flexible resin plate by an adhesive or double-sided tape and integrating the same. Also, a frictional material configuring a friction surface and a soft material such as a soft resin may be integrated by a two-color molding. Also, the entire flexible member may be configured by the frictional material such as rubber, elastomer, sponge and the like.

In the above illustrative embodiment, the restraint part is configured by the inclined surface 130. However, the disclosure is not limited thereto. For example, the restraint part may be a convex part, a stepped portion, a rib and the like.

The disclosure can be applied to an image reading apparatus, an image forming apparatus, a complex machine and the like.

What is claimed is:

1. A sheet separating apparatus comprising:

a chute member comprising a stacking part including a sheet support surface configured to support a sheet;

a separation roller configured to convey the sheet supported on the sheet support surface toward a downstream side in a conveying direction;

a flexible member having flexibility and comprising:

a first end portion positioned upstream in the conveying direction and being displaceable;

a second end portion positioned downstream in the conveying direction and facing the separation roller, a first surface of the flexible member facing the separation roller; and a hole extending in the conveying direction at the first end portion;

a holding member to which the second end portion of the flexible member is attached;

an abutting part configured to abut on a second surface, which is opposite to the first surface, of the flexible member at an intermediate position between the first end portion and the second end portion in the conveying direction; and a protrusion protruding from the chute member toward the flexible member and being inserted into the hole of the flexible member such that the first end portion of the flexible member is allowed to move in the conveying direction within a predetermined range, wherein the flexible member comprises:

an auxiliary support surface provided upstream from the intermediate position in the conveying direction and configured to support a downstream end portion of the sheet supported on the sheet support surface in the conveying direction, wherein the auxiliary support surface is bendable in a direction getting away from the separation roller in response to the flexible member being moved in the conveying direction while the abutting part maintains abutting on the second surface of the flexible member; and a friction surface provided downstream from the intermediate position in the conveying direction and configured to face the separation roller to be contactable with the separation roller, wherein the friction surface is configured to separate the sheet one at a time in cooperation with the separation roller.

2. The sheet separating apparatus according to claim 1, wherein the flexible member is entirely formed of a material configuring the friction surface.

3. The sheet separating apparatus according to claim 1, wherein the stacking part comprises an opening, the opening comprising at least a part of an area of the sheet support surface, which is positioned downstream in the conveying direction and faces the separation roller, and being recessed in the direction getting away from the separation roller, and wherein the second end portion of the flexible member is attached to the holding member with the auxiliary support surface and the friction surface being exposed from the opening.

4. The sheet separating apparatus according to claim 3, wherein the first end portion comprises a part that is positioned at an opposite surface-side of the stacking part to the sheet support surface, extends upstream from the opening in the conveying direction and is arranged with overlapping with the stacking part in a direction orthogonal to the sheet support surface.

5. The sheet separating apparatus according to claim 4, further comprising:

a piece that covers an upstream side of the opening, an upper surface of the piece forming a part of the sheet support surface at a downstream side in the conveying direction.

6. The sheet separating apparatus according to claim 3, further comprising:

a piece that covers an upstream side of the opening, an upper surface of the piece forming a part of the sheet support surface at a downstream side in the conveying direction, wherein the first end portion comprises a part that extends upstream from the opening in the conveying direction and gets into a below of a lower surface of the piece so as to overlap with the stacking part in a direction orthogonal to the sheet support surface.

7. The sheet separating apparatus according to claim 1, further comprising:

a restraint part provided to be contactable with the second surface of the flexible member to the auxiliary support surface and configured to limit a bending range of the auxiliary support surface.

8. The sheet separating apparatus according to claim 7, wherein the restraint part is an inclined surface that is positioned upstream from the abutting part in the conveying direction and is inclined to be more spaced from the separation roller toward upstream in the conveying direction.

9. The sheet separating apparatus according to claim 8, wherein the abutting part and the inclined surface are formed integrally with the stacking part together with the sheet support surface, wherein the abutting part is a rib protruding toward the separation roller, and wherein the inclined surface is inclined lower toward upstream from the abutting part in the conveying direction.

10. The sheet separating apparatus according to claim 1, further comprising:

a film extending along the auxiliary support surface toward a downstream side in the conveying direction, wherein a downstream tip end of the film in the conveying direction is positioned upstream from the friction surface in the conveying direction.

11. The sheet separating apparatus according to claim 1, further comprising:

a reading unit provided downstream from the separation roller in the conveying direction and configured to read an image of the sheet separated one at a time by the separation roller and the friction surface.

12. The sheet separating apparatus according to claim 1, wherein the protrusion is positioned upstream from the abutting part in the conveying direction, and wherein the protrusion protrudes from a bottom of a recess of the chute member.

13. The sheet separating apparatus according to claim 1, wherein the first end portion of the flexible member is allowed to move in the downstream side in the conveying direction when the flexible member is bent in the direction getting away from the separation roller.

14. The sheet separating apparatus according to claim 1, wherein the flexible member is configured to be bent in the direction getting away from the separation roller by the auxiliary support surface being pressed by the downstream end portion of the sheet applied with a force generated by a rotation of the separation roller.

15. The sheet separating apparatus according to claim 1, further comprising:

a supply roller provided at an upstream side of the separation roller in the conveying direction and configured to supply the sheet toward the separation roller.

16. The sheet separating apparatus according to claim 1, wherein the chute member comprises an opening, and wherein the sheet separating apparatus further comprises a spring arranged between a bottom of the opening and the holding member for urging the second end portion of the flexible member toward the separation roller via the holding member.

17. The sheet separating apparatus according to claim 1, wherein the first surface of the flexible member comprises the auxiliary support surface and the friction surface.

18. The sheet separating apparatus according to claim 1, wherein the abutting part is formed integrally with the stacking part.

19. The sheet separating apparatus according to claim 1, further comprising:

a restraint part configured to limit a bending range of the auxiliary support surface, the second surface of the flexible member being contactable to and separatable from the restraint part at upstream from the intermediate position in the conveying direction.

20. The sheet separating apparatus according to claim 1, wherein the auxiliary support surface is bendable in a direction getting away from the separation roller in response to the flexible member being moved in the downstream side in the conveying direction while the abutting part maintaining abutting on the second surface of the flexible member, and wherein the auxiliary support surface is bendable in a direction coming closer to the separation roller in response to the flexible member being moved in an upstream side in the conveying direction while the abutting part maintaining abutting on the second surface of the flexible member.

* * * * *